US005458562A

United States Patent [19]

Cooper

[11] Patent Number: 5,458,562

[45] Date of Patent: Oct. 17, 1995

[54] CIRCULATION ENHANCING APPARATUS

[75] Inventor: Guy F. Cooper, Ventura, Calif.

[73] Assignee: The United States of America as represented by the Secretary of the Navy, Washington, D.C.

[21] Appl. No.: 266,811

[22] Filed: Jun. 13, 1994

[51] Int. Cl.[6] ..... A61H 9/00

[52] U.S. Cl. ..... 601/151; 601/148

[58] Field of Search ..... 601/148–152; 606/201–203

[56] References Cited

U.S. PATENT DOCUMENTS

| | | | |
|---|---|---|---|
| 3,889,494 | 6/1975 | Patience et al. | 66/178 A |
| 4,044,759 | 8/1977 | Ghayouran | 601/152 |
| 4,175,562 | 11/1979 | Honan | 606/202 |
| 4,374,518 | 2/1983 | Villanueva | 124/24 R |
| 4,419,988 | 12/1983 | Mummert | 601/152 |
| 4,577,622 | 3/1986 | Jennings | 601/134 |
| 4,738,249 | 4/1988 | Linman et al. | 601/152 |
| 4,800,900 | 1/1989 | French | 606/202 X |
| 4,883,462 | 11/1989 | Williamson et al. | 601/152 X |
| 5,000,164 | 3/1991 | Cooper | 601/11 |

FOREIGN PATENT DOCUMENTS

| | | | |
|---|---|---|---|
| 12486 | 5/1909 | United Kingdom | 606/203 |

*Primary Examiner*—Robert A. Hafer
*Assistant Examiner*—Brian E. Hanlon
*Attorney, Agent, or Firm*—David S. Kalmbaugh; Melvin J. Sliwka

[57] ABSTRACT

Blood circulation in an injured human foot is involuntarily promoted in a vacuum over-pressure cycle and in synchronism with the heart's systolic and diastolic pressure pulsations. In a preferred embodiment the circulation apparatus comprises an air tight boot contoured to the injured foot, a pulsed synchronized tourniquet for inhibiting blood flow to the injured foot during an over-pressure cycle and a control circuit which monitors the heart's systolic and diastolic pressure pulsations and provides electrical control signals to the pressure modulator to assure that the over-pressure and vacuum pulses are cyclic and in synchronism with the heart's systolic and diastolic pressure pulsations.

8 Claims, 4 Drawing Sheets

CIRCULATION ENHANCING APPARATUS

BACKGROUND OF THE INVENTION

1. Field of the Invention

The present invention relates generally to an apparatus for augmenting blood circulation in a limb of a patient. In particular, the invention relates to a boot for enhancing blood circulation in a foot which is subjected to severe frost bite.

2. Description of the Prior Art

Patients exposed to severe frost bite and other forms of injuries or illness that impair blood circulation in an injured limb need enhancement of the blood circulation in order to heal or in an extreme case save the limb and provide for a full recovery. Inadequate arterial blood flow in the injured limb can lead to such problems as pain upon exertion of the limb, slow healing of injuries, breakdown of soft tissue leading to slow healing of ulcers and in the extreme, gangrene with the result and need to amputate the injured limb.

Prior art methods of restoring full blood circulation to an injured limb include medication, massaging and applying warmth to the injured limb. However, these methods are of limited value in treating severe injuries, especially frostbite.

There are also a wide variety of devices in the prior art which are designed to assist blood circulation in an injured limb. Examples of such prior art devices include: U.S. Pat. No. 4,374,518 issued to Villanueva on Feb. 22, 1983 which discloses an electronic device for pneumomassage of the limb of a patient which includes a compressor for successively inflating and deflating in a rhythmic, preselected cycle inner and outer boots enveloping the limb; and U.S. Pat. No. 4,738,249 issued to Linman et. al. on Apr. 19, 1988 which discloses a method and apparatus for cyclically increasing both venous distention and transmural pressure in the capillaries in one or more of the patient's limbs.

While these and other devices of the prior art are satisfactory for their intended purpose of enhancing blood flow through an injured limb, these blood circulation enhancing devices generally do not function in synchronism with the patient's heart or major arteries to increase blood flow through the injured limb.

In addition, these prior devices are generally not designed to significantly increase or enhance arterial blood flow which is required to overcome the effects of frostbite to an injured limb.

Accordingly, it is an object of the present invention to provide an improved apparatus for promoting and/or enhancing blood circulation within an injured limb.

It is another object of the present invention to provide for an apparatus which is capable of boosting blood circulation in a patient's limb without pain to the patient.

It is still another object of the present invention to provide for a blood circulation enhancing apparatus which is safe and simple to use and which is highly reliable, yet is relatively inexpensive to manufacture.

These and other objects, advantages and novel features of the invention will become more apparent from the detailed description of the preferred embodiment when considered in conjunction with the accompanying drawings.

SUMMARY OF THE INVENTION

The present invention pertains to a blood circulation enhancing apparatus for use with a limb that is, for example, subject to frost bite. In the preferred embodiment, the circulation enhancing apparatus comprises an air tight boot contoured to fit the injured limb of a patient which may be, for example, a foot. A pressure modulator connected to the boot provides cyclic over-pressure and vacuum conditions within the boot to enhance blood circulation through the injured limb.

The blood circulation enhancing apparatus of the present invention also includes control circuitry for monitoring the heart's systolic and diastolic pressure pulsations. The control circuitry then provides electrical control signals to the pulse modulator to insure that the over-pressure and vacuum conditions within the boot are cyclic and synchronized with the heart's systolic and diastolic pressure pulsation.

There is also provided with the blood circulation enhancing apparatus of the present invention a pulse synchronized tourniquet which is connected to the pulse modulator and which is generally positioned near a major artery of the injured limb to either restrict or allow blood flow through the major artery in synchronism with the over pressure and vacuum conditions occurring in the boot.

DETAILED DESCRIPTION OF THE PREFERRED EMBODIMENT

The preferred embodiment of the present invention will now be discussed in conjunction with all the figures of the drawings.

Figure 1:
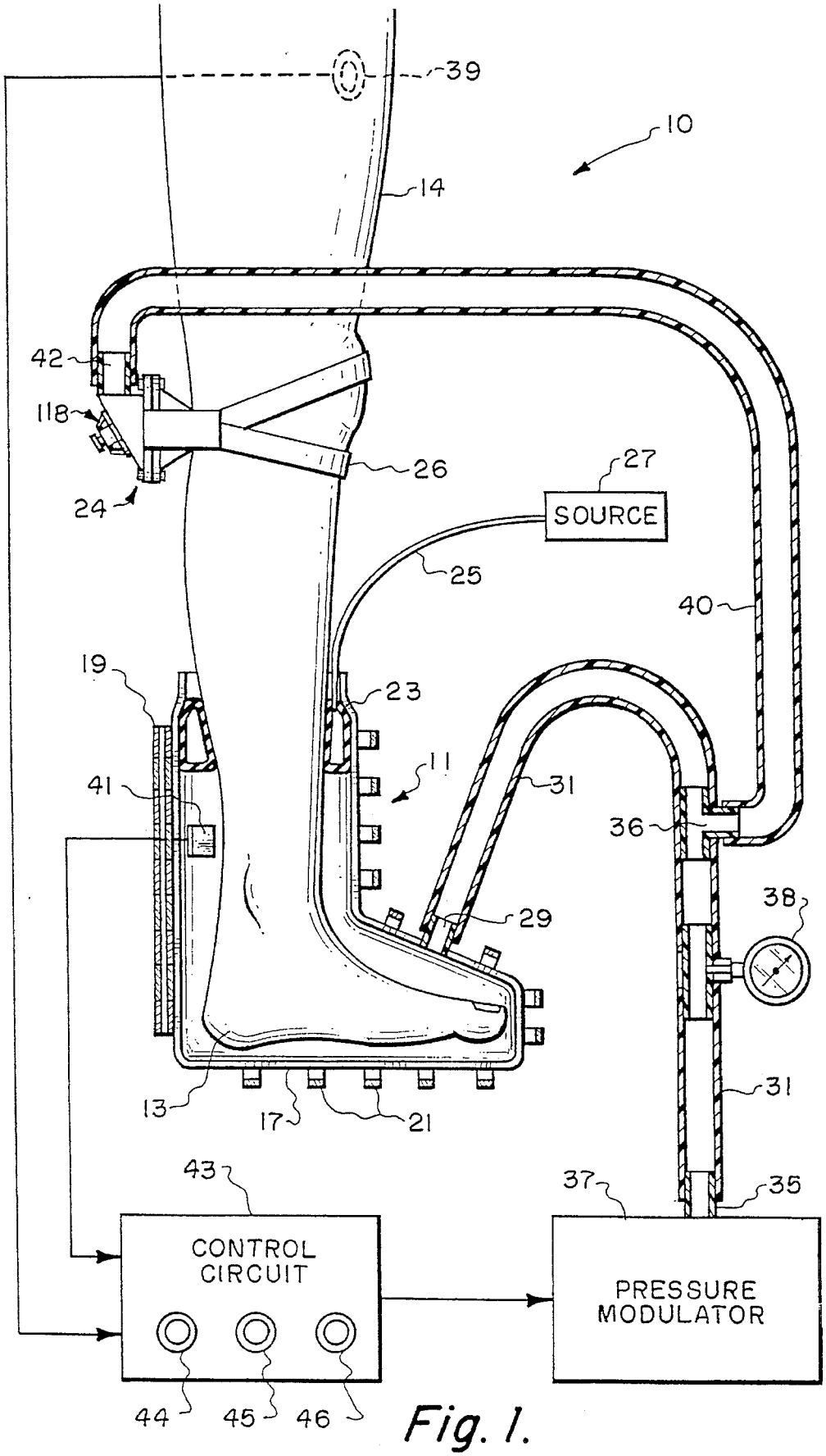
FIG. 1 is a simplified side view in section of the foot extremity of a leg to which the circulation enhancing apparatus of the present invention has been applied.

Referring first to FIG. 1, there is shown a circulation enhancing apparatus, designated generally by the reference numeral 10, which includes a circulation enhancing boot 11 that is contoured to and covers a human foot 13 and the lower portion of a leg 14 which has been subjected to frost bite or other injuries. Boot 11 is a sealed cavity surrounding foot 13 and the lower portion of leg 14 and may be fabricated from plastic, fiberglass or plexiglass if transparency is desired to allow observation of the injured foot 13.

It should be noted that boot 11 is sufficiently large in size to prevent the interior of the boot from making physical contact with injured tissue on foot 13.

Figure 2:
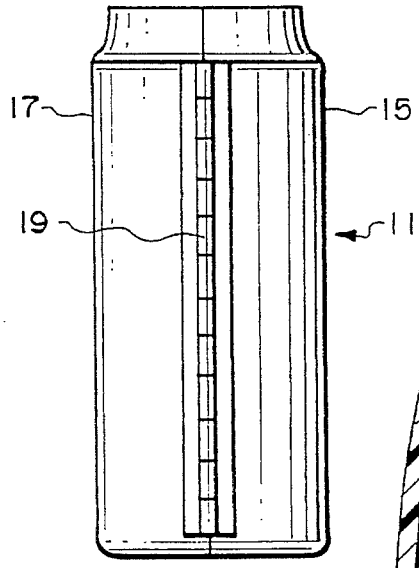
FIG. 2 is a back side view of the contoured boot of the apparatus of FIG. 1.

As is best shown in FIGS. 1 and 2 the circulation enhancing boot comprises a pair of boot halves 15 and 17 with the boot halves being joined together by a hinge assembly 19 located on the back side of boot 11. Hinge assembly 19 allows a user to either remove boot 11 from the patient's injured foot 13 or apply boot 11 to the injured foot 13 as required during the treatment of foot 13. There is also provided on the bottom and front side of boot 11 a plurality of clasp 21 which press boot halves 15 and 17 together such that a pressure seal is formed while boot 11 is being used to treat injured foot 13.

Referring again to FIG. 1, boot 11 has a pneumatic cuff 23 attached to the inner surface of boot 11 at a top portion of boot 11. Pneumatic cuff 23 is connected to a source 27 of fluid by a hose 25. Source 27 provides the fluid, which may be air, to pneumatic cuff 23 inflating cuff 23 so that cuff 23 encircles leg 14 forming an air tight seal about leg 14.

It should be understood that the air tight seal formed by pneumatic cuff 23 about leg 14 is designed not to restrict blood flow through the lower portion of leg 14 and injured foot 13. It should also be understood that pneumatic cuff 23 may be fabricated from rubber or a similar material which conforms to the contour of that portion of leg 14 about cuff 23 and is positioned to form the air tight seal for boot 11.

Circulation enhancing apparatus 10 also includes a pulsed synchronized tourniquet 24 which is positioned at the rear of leg 14 adjacent the popliteal artery of the leg 14. An elastic strap assembly 26 attached to pulsed synchronized tourniquet 24 is used to hold tourniquet 24 in a fixed position relative to the popliteal artery of the leg 14.

Connected to an inlet-outlet port 29 of boot 11 is one end of a thick wall flexible hose 31 which is fabricated from one inch inside diameter surgical rubber so that hose 31 will not collapse during the vacuum portion of a pressure cycle.

The opposite end of flexible hose 31 is connected to an inlet-outlet port 35 of a pressure modulator 37. Flexible hose 31 has a tee 36 located near its center which connects one end of a flexible hose 40 to hose 31 while the opposite end of flexible hose 40 is connected to an inlet-outlet port 42 of pulsed synchronized tourniquet 24. Flexible hose 40 is also fabricated from one inch inside diameter surgical rubber so that hose 31 will not collapse during the vacuum portion of a pressure cycle. Flexible hoses 31 and 40 may also be fabricated from a plastic such as Tygon.

Flexible hose 40 includes a pressure gauge 38 which measures fluid pressure within hoses 31 and 40 above and below ambient pressure in millimeters of mercury.

There is attached to leg 14 adjacent the femoral artery of leg 14 a pressure transducer 39 which monitors arterial blood pressure variations through the femoral artery of leg 14. Adhesive tape may be used to attach pressure transducer 39 to leg 14. A pressure transducer 41, which is positioned within boot 11 and mounted on its inner surface, monitors pressure variations within boot 11.

The electrical output of transducer 39 is connected to the first input of a control circuit 43, while the electrical output of transducer 41 is connected to the second input of control circuit 43. The electrical output of control circuit 43 is connected to the electrical input of pressure modulator 37. Control circuit 43 includes a pressure bias potentiometer 44, an artery pressure potentiometer 45 and a boot pressure potentiometer 46 which are set by an attending physician to insure that the pressure-vacuum pulsations provided by pressure modulator 37 are synchronized to the heart's systolic and diastolic pressure pulsations. In addition, potentiometers 44, 45 and 46 may be used by the attending physician to insure that pressure-vacuum pulsations within boot 11 as well as the force exerted by pulsed synchronized tourniquet 24 do not further injure the foot and leg of the patient being treated for frost bite or the like.

Figure 3:
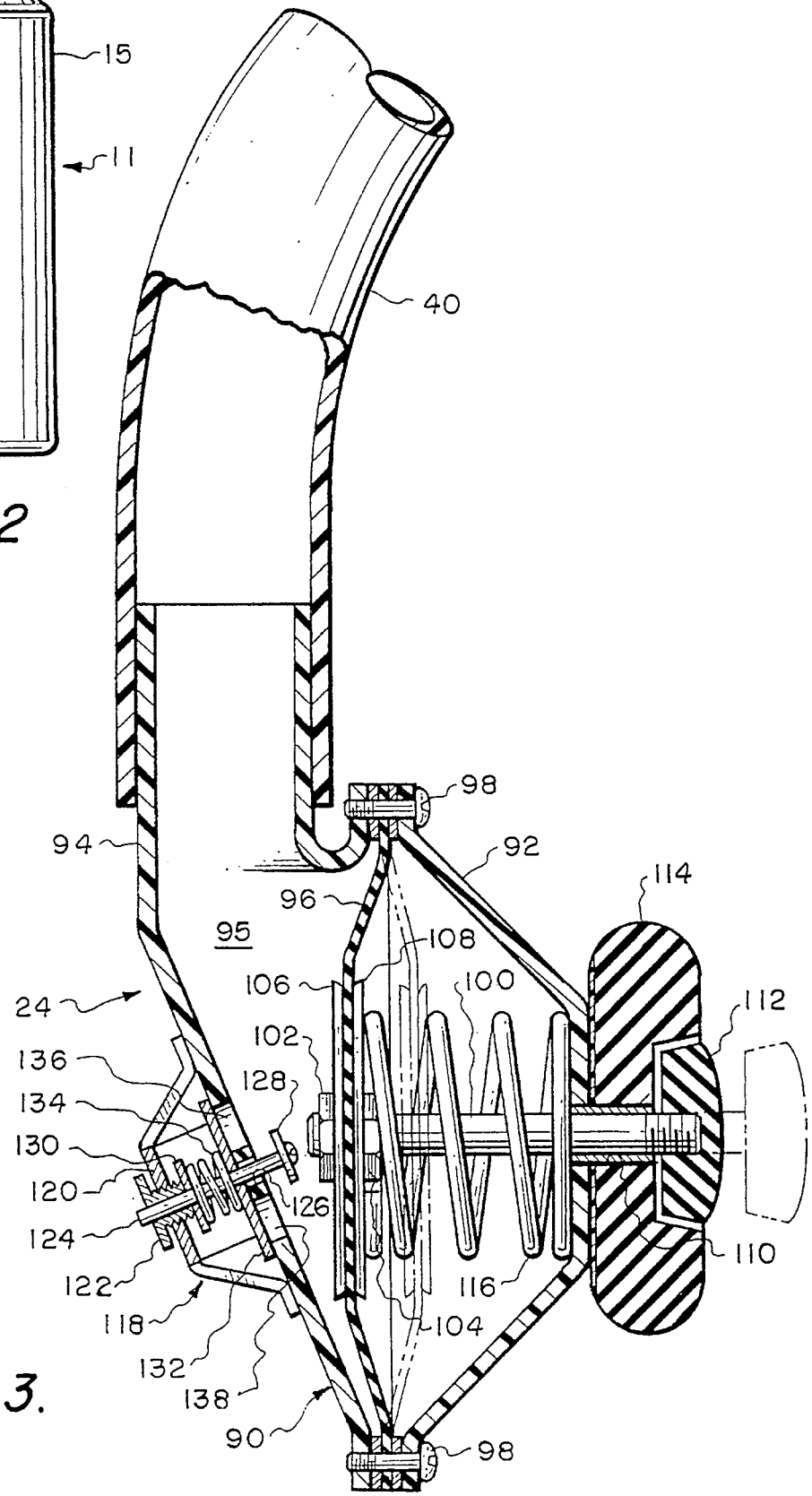
FIG. 3 is a view in section of the pulse synchronized tourniquet of the apparatus of FIG. 1.

Referring to FIG. 3, there is shown pulsed synchronized tourniquet 24 which has a housing 90 comprising a front portion 92, a rear portion 94 and a diaphragm 96 mounted within housing 90. The front portion 92 of housing 90 and diaphragm 96 are secured to the rear portion 94 of housing 90 by a plurality of machine screws 98. At this time it should be noted that housing 90 may be fabricated of plastic or any other light weight material, while diaphragm 96 may be fabricated from any high strength, flexible rubber material.

One end of a stainless steel shaft 100 is secured to diaphragm 96 by a pair of nuts 102 and 104 and a pair of washers 106 and 108. The opposite end of shaft 100, which extends from the front portion 92 of housing 90 through a sleeve 110, has a body contoured head 112 threadibly connected thereto allowing for the removal of body contoured head 112 from shaft 100. Head 112 rest within a seat 114 and may be fabricated from any commercially available rubberized compound so as not to cause injury to the patient's leg 14 when head 112 is pressed against leg 14. Seat 114, which is also fabricated from a rubberized compound, may be attached to the front portion 92 of housing 90 by a commercially available double sticky tape or Velcro which allows for its removal from housing 90.

There is also positioned between washer 108 and the front portion 92 of housing 90 around the outer surface of shaft 100 a noncorrosive metallic spring 116. Spring 116 maintains diaphragm 96 in the rearward position illustrated by FIG. 3 until air pressure is applied through a chamber 95 to the back portion of diaphragm 96 causing shaft 100 and body contoured head 112 to move in a forward direction which then presses head 112 against leg 14.

Pulsed synchronized tourniquet 24 also has a relief valve 118 which allows pressurized air to escape from chamber 95 of tourniquet 24 when an over pressure condition occurs within chamber 95 of tourniquet 24. Relief valve 118 includes an open frame support member 120 which is attached to the rear portion 94 of housing 90 and an adjustable sleeve 122 which is threadibly connected to support member 120. Sleeve 122 has one end portion of a shaft 124 passing through sleeve 122 while the opposite end portion of shaft 124 passes through an orifice 126 within the rear portion 94 of housing 90. There is attached to the end of shaft 124 a stop member 128 which prevents shaft 124 from sliding through orifice 126. There is positioned against the inner surface of sleeve 122 a washer 130 while there is positioned against the outer surface of rear portion 94 of housing 90 a washer 132. A spring 134 is placed between washer 132 and washer 130 around shaft 124. Spring 134 exerts pressure on washer 132 which covers a pair of air exhaust ports 136 and 138 within housing 90 thereby preventing pressurized air from escaping tourniquet 24 until an over pressure condition exist. When an over pressure condition exist within tourniquet 24 pressurized air will force washer 132 in a rearward direction away from housing 90 allowing air to escape through ports 136 and 138 and frame 120 into the atmosphere until the over pressure condition is alleviated. A user may adjust the pressure level at which an over pressure condition occurs within tourniquet 24 by adjusting sleeve 122 which, in turn, adjusts the pressure spring 134 exerts against washer 132.

Figure 4:
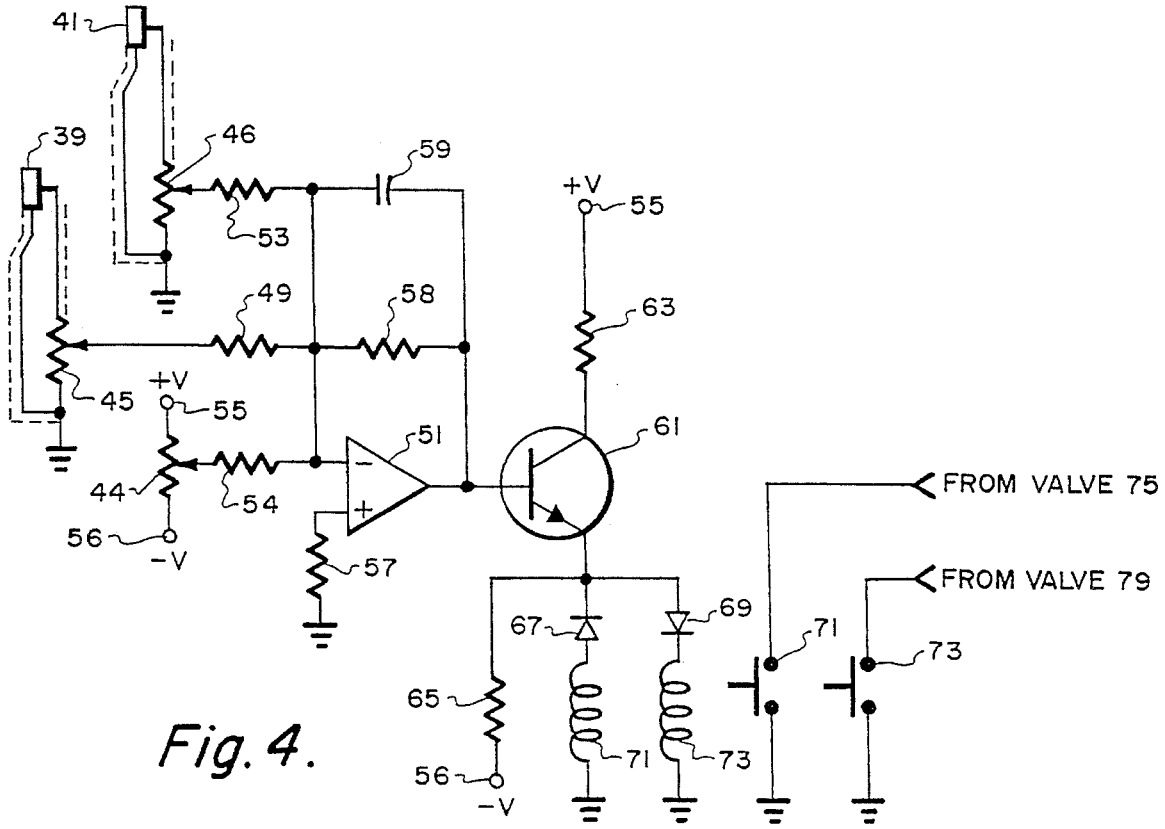
FIG. 4 is an electrical schematic diagram of the control circuitry for the apparatus of FIG. 1.

Referring now to FIG. 4, there is shown control circuit 43 which has the electrical output of transducer 39 connected through potentiometer 45 and a resistor 49 to the negative input of an integrating operational amplifier 51. Similarly, the electrical output of transducer 41 is also connected through potentiometer 46 and a resistor 53 to the negative input of integrating operational amplifier 51, while pressure bias potentiometer 44 is connected through a resistor 54 to the negative input of integrating operational amplifier 51. Potentiometer 44 is also connected between a positive direct current voltage source 55 and a negative direct current voltage source 56. Connected between the positive input of integrating amplifier 51 and ground is a resistor 57.

It should be noted that amplifier 51 may be a Model 741 operational amplifier which is commercially available from Radio Shack and other commercial suppliers. To provide for amplifier feedback there is connected between the negative input and the output of amplifier 51 a resistor 58 and a capacitor 59.

The output of integrating operational amplifier 51 is connected to the base of a power transistor 61 with the collector of transistor 61 being connected through a resistor 63 to voltage source 55 and the emitter of transistor 61 being through a resistor 65 to voltage source 56, the cathode of diode 67 and the anode of a diode 69. The anode of diode 67 is connected to the coil of a normally open relay 71, while the cathode of diode 69 is connected to the coil of a normally open relay 73.

Set forth in the following table are the values of the various electrical components used in control circuit 43.

TABLE I

| Component | Value |
|---|---|
| Potentiometers 44, 45, 46 | 100K ohms |
| Resistors 49, 53, 54 | 100K ohms |
| Resistor 57 | 10K ohms |
| Resistor 58 | 500K ohms |
| Capacitor 59 | 10 microfarads |
| Resistors 63, 65 | 47 ohms |

It should be noted that power transistor 61 may be a Model 2N2222 transistor which is available from Radio Shack and other commercial suppliers of electronics components.

It should also be noted that the values selected for resistor 58 and capacitor 59 provide an RC time constant that is commensurate with the approximate time period for the beat of the human heart while resting.

Figure 5:
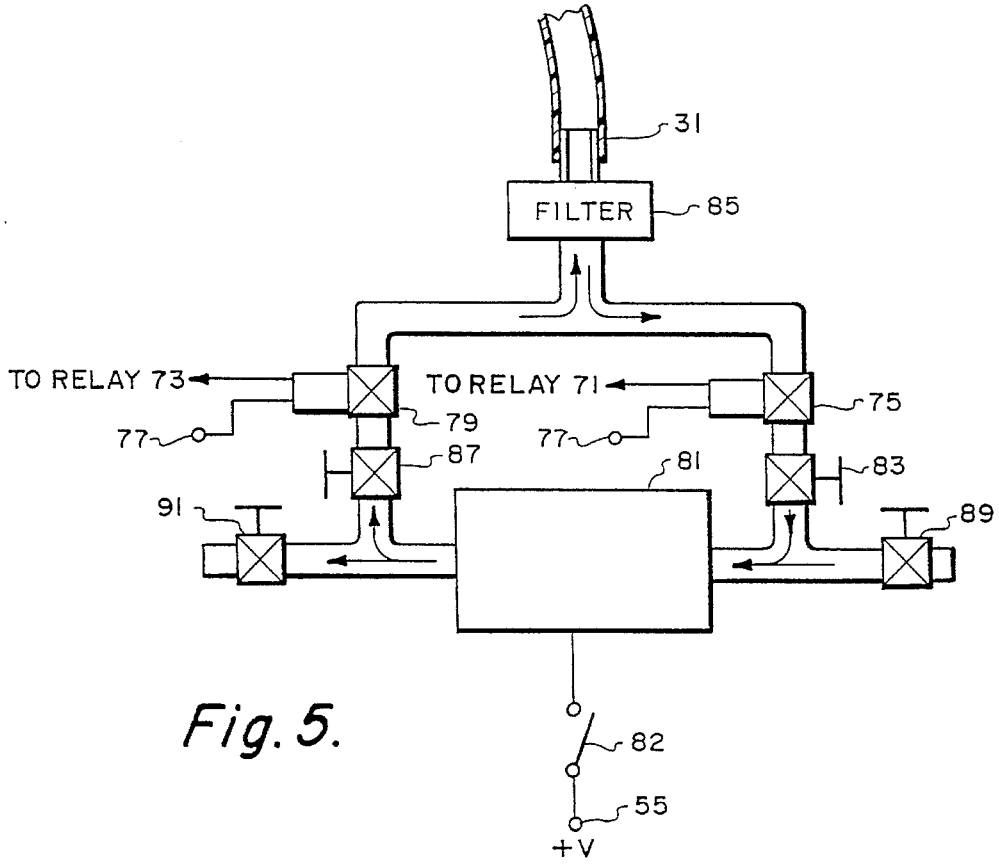
FIG. 5 is a pneumatic diagram for the pressure modulator of the apparatus of FIG. 1.

Referring now to FIG. 5 there is shown pressure modulator 37 which includes a normally closed solenoid valve 75, the electrical output of which is connected to the normally open contact of relay 71, FIG. 4, and the electrical input of which is connected to an alternating current power source 77. Pressure modulator 37 also includes a normally closed solenoid valve 79 which has an electrical output connected to the normally open contact of relay 73, FIG. 4, and an electrical input connected to alternating current power source 77.

Pressure modulator 37 has a blower pump 81 with the electrical input of blower pump 81 being connected through an electrical switch 82 to power source 55. Power source 55 may be a direct current voltage source or an alternating current voltage source. The inlet port of blower pump 81 is connected through an adjustable fluid flow restricting valve 83 to the outlet port of solenoid valve 75, while the inlet of solenoid valve 75 is connected through a filter 85 to flexible hose 31 and the outlet port of solenoid valve 79. The inlet port of solenoid valve 79 is connected through an adjustable fluid flow restricting valve 87 to the outlet port of blower pump 81. Blower pump 81 also has connected to the inlet port thereof an adjustable fluid flow restricting valve 89, while the outlet port of blower pump 81 is connected to an adjustable fluid flow restricting valve 91.

Adjustable fluid flow restricting valves 89 and 91 function as adjustable pressure regulating orifices for blower pump 81 when blower pump 81 is in an operating mode. In the preferred embodiment of the present invention, blower pump 81 comprised ten muffin fans stacked in series and each muffin fan was a Model 6248 muffin fan manufactured by Papst Mfg. Co., although it should be understood that a commercially available vacuum cleaner blower motor could function as blower pump 81.

The operation of the invention will now be discussed in conjunction with all the figures of the drawings.

Figure 6:
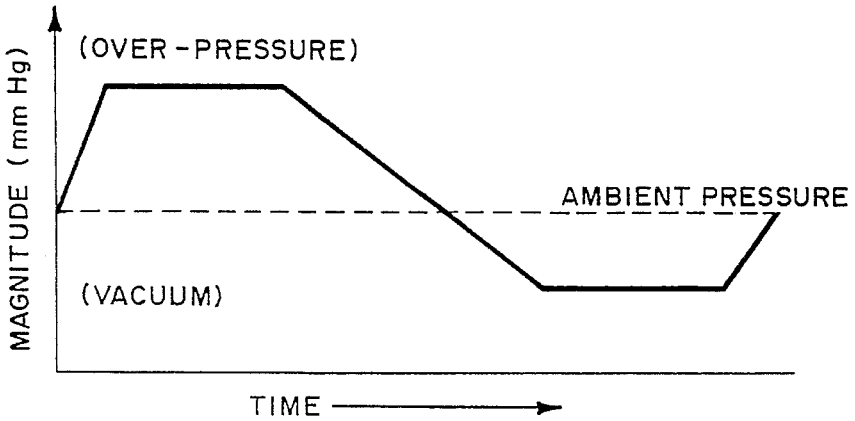
FIG. 6 is a graphical representation of the pressure-vacuum cycle within the circulation enhancing apparatus of FIG. 1.

Referring first to FIGS. 1 and 5, blower pump 81 is activated by closing electrical switch 82. When solenoid valve 79 is open and solenoid valve 75 is closed blower pump 81 draws air from the atmosphere through valve 89 and then forces air through valves 87 and 79 and filter 85 to create in circulation enhancing boot 11 and pulsed synchronized tourniquet 24 the over-pressure condition illustrated by the timing waveform of FIG. 6.

Similarly, when solenoid valve 79 is closed and solenoid valve 75 is open blower pump 81 withdraws air from circulation enhancing boot 11 and pulsed synchronized tourniquet 24 through filter 85 and valves 75 and 83 discharging the air withdrawn from boot 11 and tourniquet 24 in to the atmosphere through valve 91. This, in turn, creates in boot 11 and tourniquet 24 the vacuum condition illustrated by the timing waveform of FIG. 6. By adjusting valves 83, 87, 89 and 91, and obtaining readings using pressure gauge 38 an attending physician can adjust the magnitude of the peak over-pressure condition and the peak vacuum condition to the desired level to enhance treatment of the injured foot. Thus, if it is desired to increase the peak-to-peak magnitude of over-pressure and vacuum during a cycle because of low artery pressure to the injured foot, the attending physician may adjust valves 83, 87, 89 and 91 to provide for the desired changes in over-pressure and vacuum during the cycle illustrated by FIG. 6.

Referring to FIGS. 1, 3, 4 and 5, transducer 39 will monitor the popliteal artery's systolic pressure pulsation phase and provide to the negative input of amplifier 51 a positive analog signal indicative of the systolic pressure sensed by transducer 39. Amplifier 51 inverts this positive analog signal and then sums the signal with the signals provided by potentiometers 44 and 45 to provide a negative going signal which is supplied to the base of transistor 61 turning off transistor 61. When transistor 61 is turned off current flow is through the coil of relay 71 energizing relay 71 thereby closing the contact of relay 71 and energizing solenoid valve 75 which is now open. With solenoid valve 75 now open blower pump 81 withdraws air from boot 11 and tourniquet 24 creating a vacuum condition within boot 11 and tourniquet 24. Tourniquet 24 is now in the position illustrated by FIG. 3, that is tourniquet 24 is in an open position allowing blood to flow through the popliteal artery of leg 14 to injured foot 13. The vacuum created within circulation enhancing boot 13 forces blood into foot 13 thereby augmenting the effect of the heart's systolic pressure phase to enhance treatment of the injured foot 13.

Transducer 39 will next sense the popliteal artery's diastolic pressure and provide to the negative input of amplifier 51 a negative analog signal indicative of the diastolic pressure sensed by transducer 39. Amplifier then sums and integrates this signal with the signals provided by potentiometers 44 and 45 providing to the base of transistor 61 a positive signal. This positive signal turns on transistor 61 providing current flow through transistor 61 and diode 69 to the coil of relay 73 energizing relay 73 which closes the contact of relay 73. Closing the contact of relay 73 energizes solenoid valve 79 opening solenoid valve 79.

Blower pump 81 now draws air from the atmosphere and forces the air through valves 87 and 79 into tourniquet 24 and boot 11. When pressurized air is supplied to tourniquet 24 via hoses 36 and 40 the head 112 of tourniquet 24 is driven against leg 14 pinching the popliteal artery of the leg 14. This, in turn, significantly restricts blood flow through the popliteal artery of the leg 14 to the injured foot 13. Simultaneously, pressurized air supplied to the interior of boot 11 via hose 31 creates an over-pressure condition within boot 11 forcing venous blood to flow from injured foot 13 to the patient's heart via the veins.

At this time it should be noted that potentiometers 44, 45 and 46 need to be preset by the user so that a positive signal occurs at the negative input of amplifier 51 during the heart's systolic phase and a negative signal occurs at the negative input of amplifier 51 during the heart's diastolic phase for the successful utilization of the present invention in treating an injured foot subjected to frost bite or the like.

Transducer 41 is used to monitor excessive magnitude or prolonged pressure pulses within circulation enhancing boot 11. Transducer 41 provides an analog signal to potentiometer 46 which is set such that whenever the analog signal exceeds a first predetermined voltage magnitude amplifier 51 turns off transistor 61 which energizes the coil of relay 71 and closes the contact of relay 71. Closing the contact of relay 71 energizes solenoid valve 75. When valve 75 is opened pressurized air is withdraw from the interior of boot 11 thereby reducing pressure within boot 11.

Transducer 41 also monitors excessive or prolonged vacuum pulses within circulation enhancing boot 11. Transducer 41 provides an analog signal to potentiometer 46 which is set such that whenever the analog signal exceeds a second predetermined voltage magnitude amplifier 51 turns on transistor 61 which energizes the coil of relay 73 and closes the contact of relay 73. Closing the contact of relay 73 energizes solenoid valve 79. When valve 79 is opened pressurized air is provided to the interior of boot 11 thereby increasing pressure within boot 11.

Under normal operating conditions the magnitude of the analog signal provided by transducer 41 is small compared to the magnitude of the analog signal provided by transducer 39 and thus will not effect the over-pressure-vacuum cycle of operation of circulation enhancing boot 11 and pulsed synchronized tourniquet 24.

Figure 7:
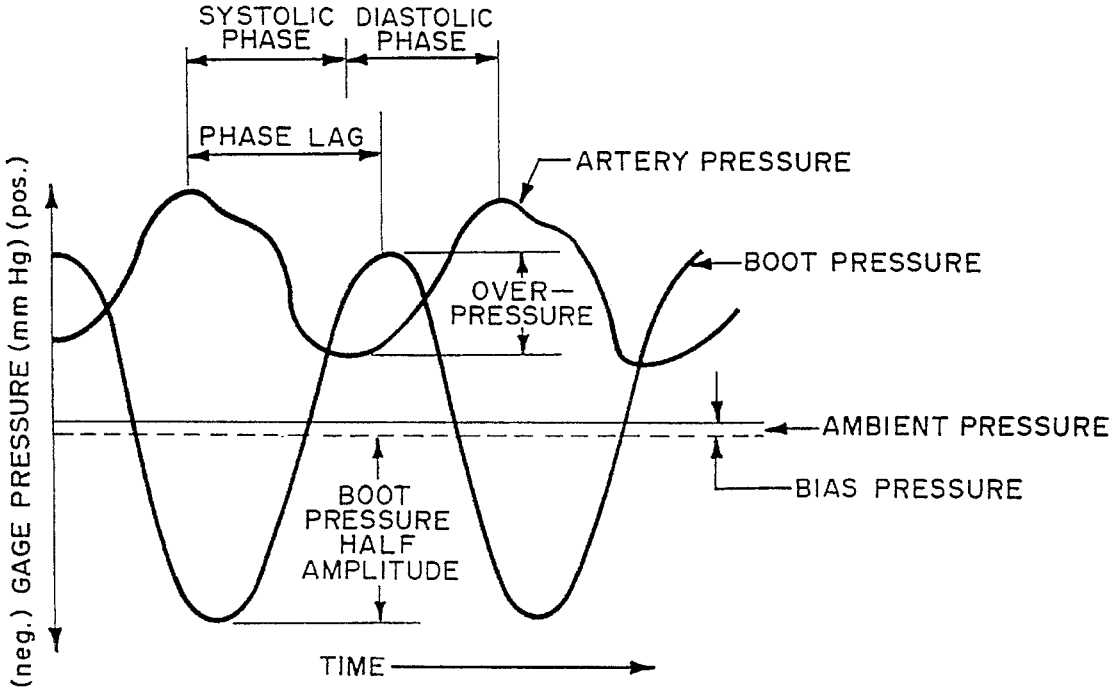
FIG. 7 is a graphical representation of the relationship between artery pressure and the pressure within the circulation enhancing apparatus of the FIG. 1.
Figure 8:
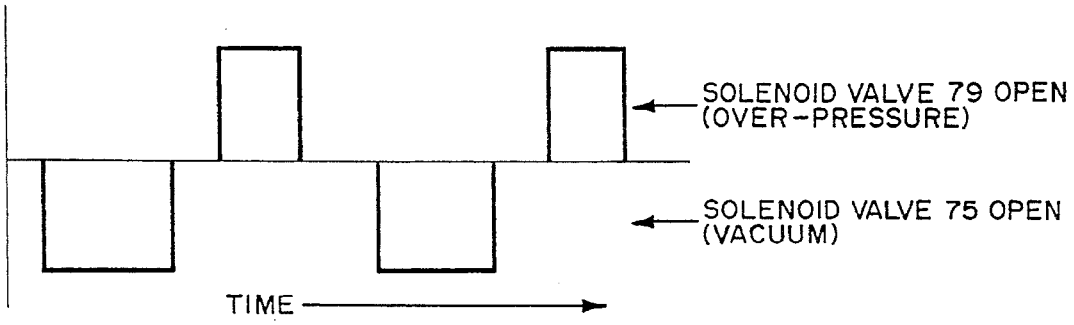
FIG. 8 is a graphical representation showing the time cycle of the pressure-vacuum cycle of the circulation enhancing apparatus of FIG. 1.

Referring to FIGS. 4, 7 and 8, potentiometers 44, 45 and 46 control the energization cycles of relay 71 and relay 73 and thus the time period during which solenoid valves 75 and 79 are open. As shown in FIG. 8 potentiometers 44, 45 and 46 are set such that the contact of relay 71 is closed for a longer time period than the contact of relay 73 thereby producing a vacuum time period cycle that is longer in duration then the pressure time cycle.

As shown in FIG. 7, there is a phase lag between the pressure of the human artery sensed by transducer 39 and the pressure-vacuum cycle of boot 11 and tourniquet 24. This phase lag would be approximately 180 degrees between the artery pressure and the boot pressure. The phase lag can be modified by changing the RC time constant of resistor 58 and capacitor 59.

It should also be noted that by contouring the shape of the element which encases an injured limb, the features of boot 11 and tourniquet 24 may be used to treat other injured extremities such as a frost bitten or crushed arm.

From the foregoing it may readily be seen that the present invention comprises a new, unique and exceedingly useful circulation enhancing apparatus for treating an injured foot or the like which constitutes a considerable improvement over the known prior art. Obviously, many modifications and variations of the present invention are possible in light of the above teachings. It is therefore to be understood within the scope of the appended claims, that the invention may be practiced otherwise than as specifically claimed.

What is claimed is:

1. A device for augmenting blood circulation in a patent's injured foot comprising:

an airtight boot adapted to encase said injured foot, said airtight boot having an inlet-outlet port;

monitor means attached to a corresponding leg of said patient for monitoring blood pressure within said corresponding leg, said monitor means having an electrical output for providing an electrical signal indicative of the blood pressure within said corresponding leg;

pressure modulator means having an inlet-outlet port connected to the inlet-outlet port of said airtight boot for providing a pressure-vacuum cycle for supplying air to said airtight boot to expel blood from said injured foot and then withdrawing air from said airtight boot creating a partial vacuum within said airtight boot to draw blood into said injured foot;

a pulsed synchronized tourniquet positioned on said corresponding leg adjacent an artery within said corresponding leg, said pulsed synchronized tourniquet having an inlet-outlet port connected to the inlet-outlet port of said pressure modulator, said pulsed synchronized tourniquet receiving air from said pressure modulator to inhibit blood flow through the artery of said corresponding leg into said injured foot when said airtight boot expels blood from said injured foot;

said pressure modulator means withdrawing air from said pulsed synchronized tourniquet to allow blood flow through the artery of said corresponding leg into said injured foot when said airtight boot draws blood into said injured foot; and control circuit means having an input connected to the electrical output of said monitor means for receiving said electrical signal from said monitor means;

said control circuit means responsive to said electrical signal controlling said pressure-vacuum cycle by which said pressure modulator means supplies air to said airtight boot and said pulsed synchronized tourniquet and then withdraws air from said airtight boot and said pulsed synchronized tourniquet;

said pulsed synchronized tourniquet comprising:

a housing having said inlet-outlet port of said pulsed synchronized tourniquet located at the top of said housing;

a flexible diaphragm mounted within said housing, one side of said flexible diaphragm and a rear portion of said housing forming a chamber;

a shaft having one end attached to another side of said flexible diaphragm, the opposite end of said shaft extending through a sleeve of said housing, the sleeve of said housing being mounted in a front portion of said housing;

a removable head coupled to the end of shaft extending from said housing, said removable head being positioned adjacent the artery of said corresponding leg;

a spring mounted within said housing around said shaft; and an elastic strap assembly attached to said housing, said elastic strap assembly holding said pulsed synchronized tourniquet in a fixed position on said leg.

2. The device of claim 1 wherein said pressure modulator means comprises a transducer.

3. The device of claim 1 further comprising a pressure transducer mounted on the inner surface of said airtight boot, said airtight boot having an output connected to said control circuit means.

4. The device of claim 1 wherein said airtight boot is fabricated from plexiglass.

5. The device of claim 1 wherein said airtight boot is fabricated from fiberglass.

6. The device of claim 1 further comprising a filter connected between the inlet-outlet port of said airtight boot and the inlet-outlet port of said pressure modulator means.

7. The device of claim 1 further comprising a pneumatic cuff attached to the inner surface of said airtight boot at a top portion of said airtight boot.

8. The device of claim 1 wherein the housing of said pulsed synchronized tourniquet has a relief valve located in the rear portion of said housing.

* * * * *